US011261698B2

(12) United States Patent
Fripp et al.

(10) Patent No.: US 11,261,698 B2
(45) Date of Patent: Mar. 1, 2022

(54) AUTONOMOUS INFLOW CONTROL DEVICE WITH A WETTABILITY OPERABLE FLUID SELECTOR

(71) Applicant: HALLIBURTON ENERGY SERVICES, INC., Houston, TX (US)

(72) Inventors: Michael Linley Fripp, Carrollton, TX (US); Stephen Michael Greci, Little Elm, TX (US); Larry Steven Eoff, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 258 days.

(21) Appl. No.: 15/756,559

(22) Filed: Feb. 28, 2018

(65) Prior Publication Data

US 2019/0040714 A1 Feb. 7, 2019

(51) Int. Cl.

| | |
|---|---|
| ***E21B 34/06*** | (2006.01) |
| ***E21B 43/08*** | (2006.01) |
| ***E21B 43/12*** | (2006.01) |

(52) U.S. Cl.

CPC ..... *E21B 34/06* (2013.01); *E21B 43/084* (2013.01); *E21B 43/12* (2013.01)

(58) Field of Classification Search

CPC ..... E21B 34/06; E21B 43/084; E21B 43/12

See application file for complete search history.

(56) References Cited

U.S. PATENT DOCUMENTS

| | | | | |
|---|---|---|---|---|
| 8,474,534 | B1 | 7/2013 | Fripp et al. | |
| 8,584,762 | B2 | 11/2013 | Fripp et al. | |
| 9,316,095 | B2 | 4/2016 | Holderman | |
| 9,371,720 | B2 | 6/2016 | Holderman | |
| 2008/0236839 | A1 | 10/2008 | Oddie | |
| 2011/0198097 | A1* | 8/2011 | Moen | G05D 7/0126 166/373 |

(Continued)

FOREIGN PATENT DOCUMENTS

| | | | |
|---|---|---|---|
| CN | 106367726 | A * | 2/2017 |
| EP | 2620587 | A3 | 10/2015 |

(Continued)

OTHER PUBLICATIONS

Li, J., Li, CX., Chen, QY. et al. Super-Hydrophobic Surface Prepared by Lanthanide Oxide Ceramic Deposition Through PS-PVD Process. J Therm Spray Tech 26, 398-408 (2017). https://doi.org/10.1007/s11666-016-0499-0 (Year: 2017).*

(Continued)

*Primary Examiner* — Blake Michener
*Assistant Examiner* — Theodore N Yao
(74) *Attorney, Agent, or Firm* — Haynes and Boone, LLP

(57) ABSTRACT

Flow control systems are described for variably resisting flow of a fluid composition dependent on the surface energy of the fluid composition. Surface energy is a measure of the wettability of a surface with a particular the fluid. Surface energy dependent flow resistors of the present disclosure include a support structure extending across and/or filling a control passageway such that the surface area exposed to a fluid may be maximized. The flow control systems described may autonomously distinguish between fluid compositions having high and low proportions of a desired fluid component even when the fluid compositions have substantially equal viscosities. Flow control valves are described which may be employed in downhole production and injection equipment.

20 Claims, 6 Drawing Sheets

(56) References Cited

U.S. PATENT DOCUMENTS

| | | | | |
|---|---|---|---|---|
| 2012/0061088 | A1 | 3/2012 | Dykstra et al. | |
| 2012/0255739 | A1* | 10/2012 | Fripp | E21B 43/12 166/373 |
| 2013/0048299 | A1 | 2/2013 | Fripp et al. | |
| 2013/0180401 | A1* | 7/2013 | Ren | E21B 43/12 95/241 |
| 2013/0186634 | A1* | 7/2013 | Fripp | E21B 34/08 166/319 |
| 2013/0192852 | A1* | 8/2013 | Mazyar | E21B 34/08 166/386 |
| 2014/0048279 | A1* | 2/2014 | Holderman | E21B 43/10 166/369 |
| 2014/0048282 | A1* | 2/2014 | Dykstra | E21B 43/12 166/373 |
| 2015/0053417 | A1 | 2/2015 | Holderman | |
| 2015/0075407 | A1* | 3/2015 | Peregnina Gomez | C09K 3/18 106/244 |
| 2015/0361773 | A1* | 12/2015 | Agrawal | E21B 41/02 166/378 |

FOREIGN PATENT DOCUMENTS

| | | | |
|---|---|---|---|
| WO | WO-2011097101 | A1 | 8/2011 |
| WO | WO-2013095419 | A1 | 6/2013 |
| WO | WO-2014116236 | A1 | 7/2014 |
| WO | WO-2015012846 | A1 | 1/2015 |

OTHER PUBLICATIONS

Azimi, G., Dhiman, R., Kwon, HM. et al. Hydrophobicity of rare-earth oxide ceramics. Nature Mater 12, 315-320 (2013). https://doi.org/10.1038/nmat3545 (Year: 2013).*

Tian, Y., Jiang, L. Intrinsically robust hydrophobicity. Nature Mater 12, 291-292 (2013). https://doi.org/10.1038/nmat3610 (Year: 2013).*

Korean Intellectaul Property, PCT/US2017/045377, International Search Report and Written Opinion, dated Dec. 26, 2017, 19 pages, Korea.

French Intellectual Property Office, Search Report, Application FR1856078, dated Mar. 26, 2021, 11 pages, France.

* cited by examiner

AUTONOMOUS INFLOW CONTROL DEVICE WITH A WETTABILITY OPERABLE FLUID SELECTOR

BACKGROUND

A wellbore is often drilled into a geologic formation in order to produce one or more desired fluids, e.g., hydrocarbons, from a subterranean reservoir. During production operations, it is common for an undesired fluid, e.g., water, to be produced along with the desired fluid. The proportion of the desired fluid in the overall inflow may change over time and may not be consistent among various production intervals defined along the entire length of a wellbore. Accordingly various wellbore completion assemblies have been developed to balance the production of fluids over time and over the production intervals, thereby increasing the productivity of the wellbore. In some instances these completion assemblies may operate autonomously, e.g., the completion assemblies may include control valves responsive to changes in the composition of the inflow without requiring any monitoring or intervention from an operator at the surface.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Some well systems operate to distinguish between fluid flows having high and low proportions of a desired fluid by including a viscosity dependent flow resistors. These systems may be less effective to control fluid flows where very small viscosity differences exist between the desired and undesired fluids. For example, a wellbore drilled in certain geographic regions such as the Arabian Peninsula may produce fluid flows with a viscosity difference of less than 1 centipoise (cP). This very small viscosity difference makes flow control difficult using viscosity dependent equipment, e.g., by making the operability of the equipment more sensitive to manufacturing tolerances. Aspects of the present disclosure relate to flow control systems for variably resisting flow of a fluid composition dependent on the surface energy of the fluid composition. Surface energy is a measure of the wettability of a surface with a particular the fluid. Surface energy dependent flow resistors of the present disclosure include a support structure extending across and/or filling a control passageway such that the surface area exposed to a fluid may be maximized.

Figure 1:
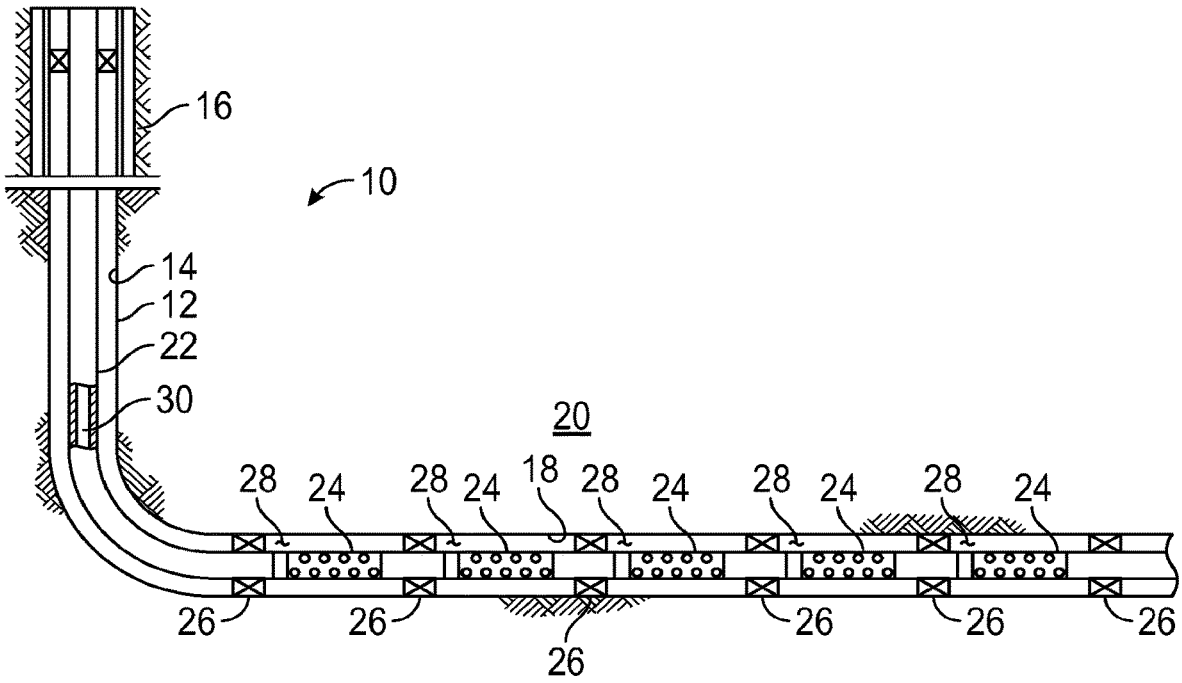
FIG. 1 is a cross sectional view of a wellbore extending through a geologic formation and containing a plurality of inflow control devices therein in accordance with aspects of the present disclosure.

FIG. 1 is a schematic illustration of a well system 10 disposed in a wellbore 12 in accordance with principles of the present disclosure. The wellbore 12 has a substantially vertical section 14 with a casing string 16 installed in an upper portion thereof. The wellbore 12 also has a substantially horizontal section 18, which extends through a hydrocarbon bearing geologic formation 20. Although FIG. 1 illustrates a wellbore with a horizontal section 18, other orientations for a deviated section are also contemplated to accommodate a particular subterranean reservoir. Also, although the horizontal section 18 is illustrated as an open hole section, aspects of the disclosure may be practiced in a cased sections as well.

A tubing string 22 is disposed within the wellbore 12 and extends from a surface location (not shown). The tubing string 22 provides a conduit for fluids to travel from the geologic formation 20 to the surface location. Coupled within the tubing string 22 is a plurality of autonomous inflow control devices 24 positioned in various production intervals adjacent to the formation 20. At either end of each production interval, a packer 26 is provided that provides a fluid seal between tubing string 22 and the wall of the wellbore 12. The inflow control devices 24 provide a mechanism for controlling the amount of fluid flowing from an exterior annular space 28 between each pair of adjacent packers 26 and an interior passageway 30 of the tubing string 22. Although the well system 10 is described herein as a "production" system that collects fluids from the geologic formation 20 and delivers the fluids to the surface location, in other embodiments, a well system may be arranged to as an "injection" system that operates to deliver fluids from the surface location to the geologic formation. 20.

Each of the inflow control devices 24 may optionally be associated with a sand control element, e.g., a screen or filter media, to permit the introduction of fluids into the inflow control device but prevent particulate matter of sufficient size from flowing therethrough. In some embodiments, the filter media may be of the type known as "wire-wrapped," since it is made up of a wire closely wrapped helically about a wellbore tubular, with a spacing between the wire wraps being chosen to allow fluid flow through the filter media while keeping particulates that are greater than a selected size from passing between the wire wraps. It should be understood that the generic term "filter media" as used herein is intended to include and cover all types of similar structures which are commonly used in gravel pack well completions which permit the flow of fluids through the filter or screen while limiting and/or blocking the flow of particulates (e.g., other commercially-available screens; slotted or perforated liners or pipes; sintered-metal screens; sintered-sized, mesh screens; screened pipes; pre-packed screens and/or liners; or combinations thereof). Also, a protective outer shroud having a plurality of perforations therethrough may be positioned around the exterior of any such filter medium.

Through the use of the inflow control devices 24 in one or more production intervals, some control over the volume and composition of the produced fluids may be enabled. For example, in an oil production operation, if an undesired fluid component, such as water, steam, carbon dioxide, or natural gas, is entering one of the production intervals, the inflow control device 24 in that interval will autonomously restrict or resist production of the undesired fluid from that interval while other inflow control devices 24 in other intervals continue to permit production of the desired fluids into the interior passageway 30 of the tubing string 22. It will be appreciated that whether a fluid is a desired or an undesired fluid depends on the purpose of the production operation being conducted. For example, if it is desired to produce oil from a well, but not to produce water or gas, then oil is a desired fluid and water and gas are undesired fluids. Alternatively, if it is desired to produce natural gas from a well, but not to produce water, then natural gas is a desired fluid and water is an undesired fluid.

The fluid flowing into the interior passageway 30 of the tubing string 22 typically comprises more than one fluid component. Typical components may include natural gas, oil, water, steam, and/or carbon dioxide. The proportion of these components in the fluid flowing into each production interval will vary over time, and is generally based on conditions within the geologic formation 20 and the wellbore 12. Likewise, the composition of the fluid flowing into the inflow control devices 24 throughout the length of the entire tubing string 24 can vary significantly from interval to interval. The inflow control devices 24 are designed to reduce or restrict the production of undesired fluids from any particular interval. Accordingly, a greater proportion of desired fluid component, e.g., oil, will be produced into the interior passageway 30 of the tubing string. 22

Although FIG. 1 illustrates a single inflow control device 24 in each production interval, it should be understood that any number of inflow control devices 24 may be deployed within a production interval without departing from the principles of the present disclosure. Likewise, not every production interval must be associated with an inflow control device 24. For example, an inflow control device 24 may only be present in some of the production intervals, or may be disposed to receive fluids from multiple production intervals.

Figure 2:
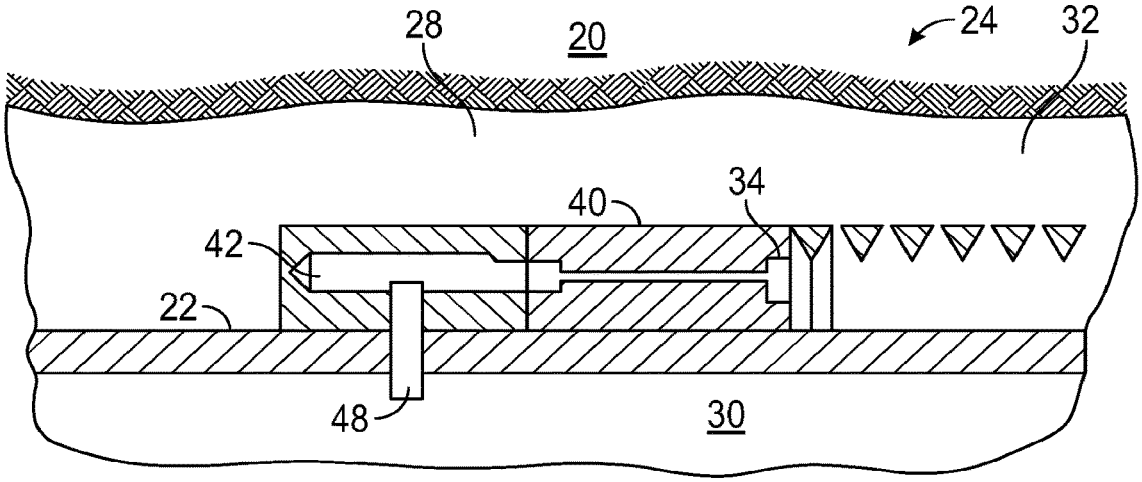
FIG. 2 is a cross sectional side view of one of the inflow control device of FIG. 1 illustrating fluid pathway extending between an exterior annulus in the wellbore and an interior of a tubing string.

FIG. 2 is a cross-sectional side view of an inflow control device 24 disposed within the annular space 28 between the tubing string 22 and the geologic formation 20. A screen system 32 is provided in the annular space 28 and prevents the passage of particulates of a particular size therethrough. The screen system 32 permits the passage of fluids from the annular space 28 to an inlet 34 of an autonomous control valve 36. As illustrated in FIG. 2, the fluids may freely enter the inlet 34. In some other embodiments, flow through the inlet 34 may be selectively prohibited by an inflow control valve (not shown). From the inlet 34, the fluid may pass through a flow ratio control section 40, which as described in greater detail below, may include control passageways with surface energy dependent flow resistors therein. From the flow ratio control section 40, the fluid may pass into a vortex chamber 42, which as described in greater detail below, provides a variable amount of flow resistance to the fluid depending on the composition. An outlet 48 of the vortex chamber 42 extends into the interior passageway 30 of the tubing string 22.

Figure 3A:
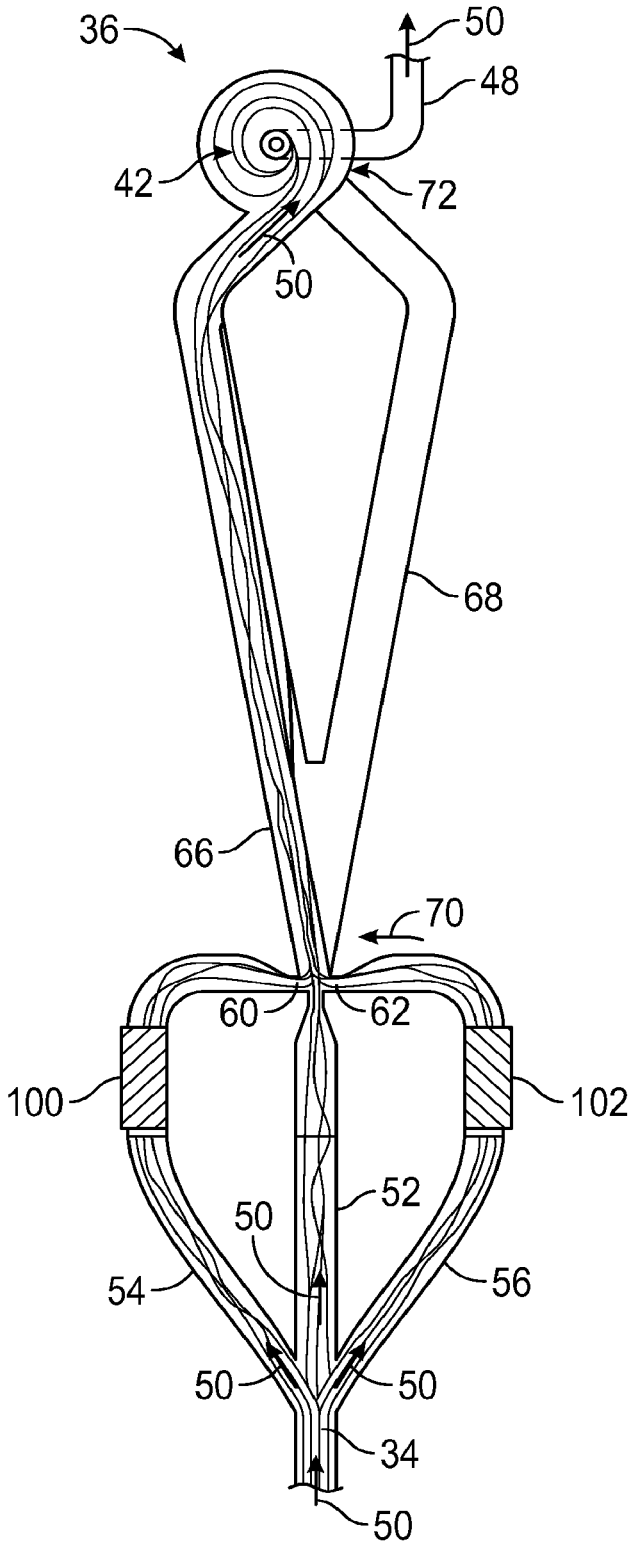
FIG. 3A is a schematic view of an autonomous control valve operable within the fluid pathway of FIG. 2, the autonomous control valve including a pair of control passageways each including a surface energy dependent flow resistor therein for controlling an inflow having a relatively high proportion of an undesired fluid to move through the control valve in a relatively high resistance pattern.

Referring now to FIG. 3A, a schematic view of the autonomous control valve 36 is illustrated in a generally planar configuration. As described above, a fluid composition 50 enters the control valve 36 via the inlet 34, and exits the control valve 36 via the outlet 48. A resistance to flow through the control valve 36 varies based on the path the fluid composition takes through the valve 36, and the path of the fluid composition 50 depends on the wettability of flow resistors 100, 102 by the particular fluid composition 50. For example, the fluid resistors 100, 102 are each constructed to exhibit different wettability characteristics to the fluid composition 50 such that a predetermined flow resistance may be generated based on the proportion of desirable and undesirable fluid components. In the example illustrated in FIG. 3A, fluid composition 50 includes a relatively high proportion of an undesired fluid component (water, in this example) and a relatively low proportion of a desired fluid component (oil, in this example). Thus, the fluid composition 50 moves through the valve 36 along a path with a relatively high resistance to fluid flow.

Upon, entering through the inlet 34, The fluid composition 50 is initially divided into three distinct flow passages including a primary passageway 52 and multiple control passageways 54, 56. The control passageways 54 and 56 direct a portion of the fluid composition 50 to flow through the flow resistors 100, 102. The flow resistor 100 may be constructed with a hydrophobic and/or oleophilic material (repelling water and/or attracting oil) and the flow resistor 102 may be constructed with a hydrophilic and/or oleophobic material (attracting water and/or repelling oil). Thus, the fluid composition 50 (with a relatively high proportion of water and a relatively low proportion of oil) will pass more easily through the flow resistor 102 than through the flow resistor 100. Relatedly, more of the fluid composition 50 may pass through the control passageway 56 than through control passageway 54. As described in greater detail below (see, e.g., FIGS. 7A through 7C) the flow resistors 100, 102 may be arranged to cause the fluid composition 50 to pass through a support structure extending across the respective control passageways 54 and 56 such that the wettability of the flow resistors may effectively influence the resistance to the flow of the fluid composition.

Control passageways 54, 56 may each include a respective control port 60, 62 at a downstream end with a reduced flow area with respect to a remainder of the control passageway 54, 56. The control ports 60, 62 may operate to increase a velocity of the fluid exiting the control passage 54, 56 or to direct the flow exiting the control passage 54, 56 onto the flow in the primary passageway 52. For example, the control ports may direct the flow exiting the control passage 54, 56 perpendicularly onto the flow in the primary passageway 52 (as shown) or at a more tangential angle (not shown). The ratio of flow exiting the control passages 54, 56 determines which of a pair of vortex chamber inlet passageways 66, 68 a majority of the flow from the three distinct flow passageways 52, 54, 56 will enter. In the example illustrated in FIG. 3A, the fluid exiting the control passageway 56 imparts a net force on the fluid exiting the primary passageway and 52 and control passageway 54 in the general direction of arrow 70. This is due to the fluid exiting the control port 62 at a greater rate, higher velocity and/or greater momentum than fluid exiting the other control port 60. The imparted force causes a majority of the fluid composition 50 flow into the inlet passageway 66.

Fluid from the vortex chamber inlet passageway 66 is discharged into the vortex chamber 42 along a trajectory that is generally tangential to an outer cylindrical edge 72 of the vortex chamber 42. The fluid composition 50 spirals about the vortex chamber 42, increasing in velocity as it nears the central outlet 48, driven by a pressure differential from the inlet passageway 66 to the outlet 48. The vortex chamber 42 thus imparts a relatively high resistance to the fluid composition 50 entering from the inlet passageway 66 before being discharged from control valve 36 to the interior passageway 30 (FIG. 2) of the tubing string 22.

Figure 3B:
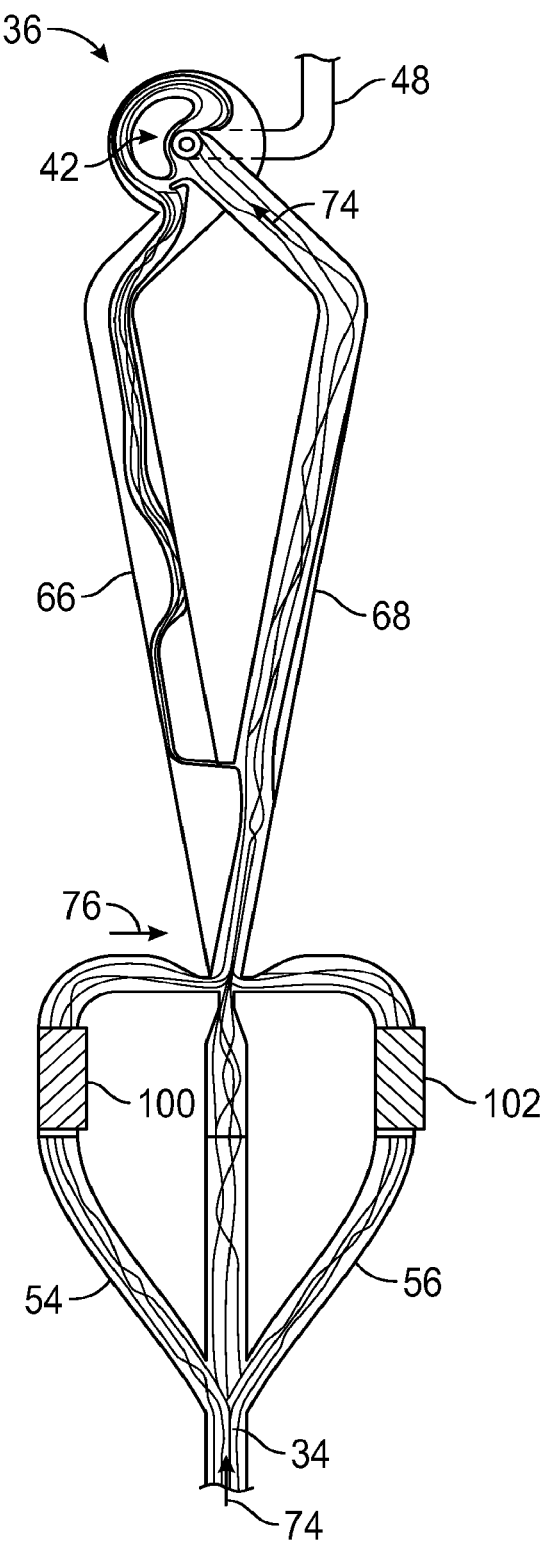
FIG. 3B is a schematic view of the autonomous control valve of FIG. 3A wherein the surface energy dependent flow resistors control an inflow having a relatively high proportion of a desired fluid to move through the control valve in a relatively low resistance pattern.

In contrast, a fluid composition 74 entering the vortex chamber from the inlet passageway 68 is imparted with a relatively low resistance as illustrated in FIG. 3B. The fluid composition 74 may be characterized as having a relatively high proportion of the desired fluid component (oil) and a relatively low proportion of the undesired fluid component (water) as compared to the fluid composition 50 (FIG. 3A). Since the fluid resistor 100 is constructed of a hydrophobic and/or oleophilic material and the flow resistor 102 is constructed with a hydrophilic and/or oleophobic material, the fluid composition 74 will pass more easily through the flow resistor 100 than through the flow resistor 102. The fluid composition 74 thus exits the control passageway 54 with greater force than the fluid composition 74 exiting control passageway 56. A force in the general direction of arrow 76 is imparted to the fluid composition 74 such that a majority of the fluid composition 74 flows through the vortex chamber inlet passageway 68. Fluid from the vortex inlet passageway 68 is discharged into the vortex chamber 42 along a trajectory that is generally radial with respect to the outer cylindrical edge 72. Thus, a majority of the fluid composition 74 may flow directly from the vortex inlet passageway 68 to the central outlet 48 without spiraling in the vortex chamber 42.

As described above with respect to FIGS. 3A and 3B, the control valve 36 is configured to provide less flow resistance to fluid composition 74 than to fluid composition 50, even when the fluid compositions 50, 74 exhibit substantially the same viscosity, e.g., with a viscosity difference of less than about 3 cP or less than about 1 cP in some embodiments. Generally, as the proportion of a fluid composition changes, and the flow resistor 100 consequently becomes more wettable by the fluid composition (and/or the flow resistor 102, becomes less wettable by the fluid composition) the control valve 36 provides less resistance to the flow of the fluid composition. This is beneficial when it is desired to flow more of a fluid with greater affinity to the hydrophobic and/or oleophilic material of the flow resistor 100 and less of a fluid with a lower affinity to the hydrophobic and/or oleophilic material of the flow resistor 100. If it is desired flow more of a fluid with a lesser affinity to the hydrophobic and/or oleophilic material of the flow resistor 100, e.g., the fluid composition 100, the control valve 36 may be readily reconfigured for this purpose. For example, the position of the flow resistors 100, 102 could be reversed.

Figure 4:
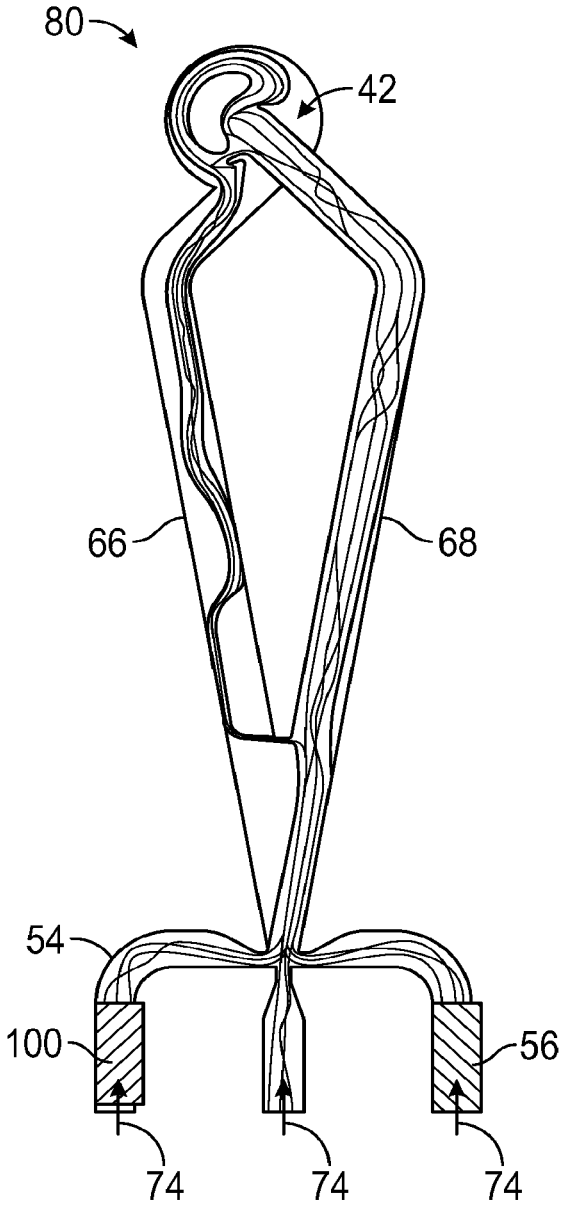
FIG. 4 is a schematic view of an alternate autonomous control valve wherein only a single one of the control passageways includes a surface energy dependent flow resistor therein.

Referring to FIG. 4, a control valve 80 is illustrated where only a single flow resistor 100 is provided. Although no flow resistor is provided in control passageway 56, the control valve 80 may operate similarly to the control valve 36 (FIG. 3B). Where a fluid composition 74 with a relatively high proportion of oil is introduced to flow passageways 52, 54 and 56, the hydrophobic and/or oleophilic material of the flow resistor 100 will attract the fluid composition 74 and urge a majority of the fluid composition 74 into the vortex inlet passageway 68, which will in turn direct the fluid composition 74 through the vortex chamber 42 in the relatively low resistance radial direction. Although FIG. 4 illustrates the flow resistor 100 provided in control in control passageway 54, other configurations with only a single flow resistor may be readily constructed. For example, the flow resistor 100 may alternately be provided in control passageway 56, or the flow resistor 102 (FIG. 3A) may be provided in either control passageway 54, 56. Regardless of the positioning or the affinity for a particular fluid component, any flow resistor constructed with a strong wettability sensitivity material may be employed to generate a force to guide a fluid composition along a high and low resistance pathways through a control valve is contemplated.

Figure 5:
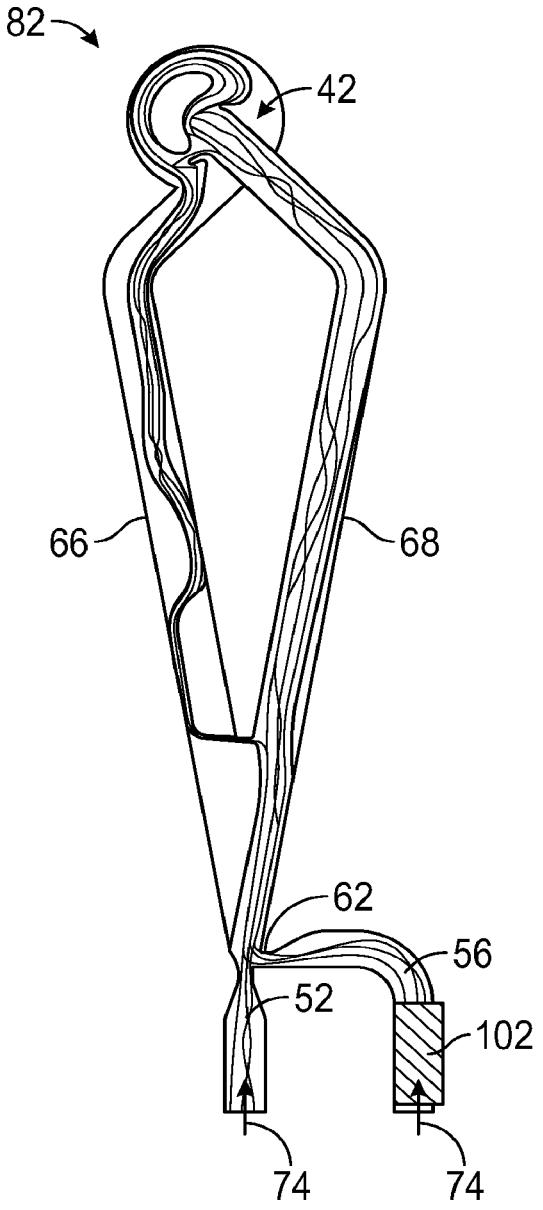
FIG. 5 is a schematic view of another alternate autonomous control valve including only one single control passageway.

FIG. 5 illustrates another control valve 82 where only a single flow resistor 102 is provided within control passageway 56. The control valve 82 includes a primary passageway 52 and control passageway 56, but lacks the control passageway 54 (FIG. 3A) described above. Although no control passageway 54 is provided, control valve 82 may operate autonomously to provide high and low resistance pathways therethrough. As illustrated in FIG. 5, where a fluid composition 74 with a relatively high proportion of oil is introduced to flow passageways 52 and 56, the hydrophilic and/or oleophobic material of the flow resistor 102 will repel the fluid composition 74 and allow a majority of the fluid composition 74 into the vortex inlet passageway 68, which will in turn direct the fluid composition 74 through the vortex chamber 42 in the relatively low resistance radial direction. When a fluid composition 50 (FIG. 3A) with a relatively high proportion of water is introduced to flow passageways 52 and 56, the hydrophilic and/or oleophobic material of the flow resistor 102 will attract the fluid composition 50 and provide a force at control port 62 to urge a majority of the fluid composition 50 into the vortex inlet passageway 66, which will in turn, direct the fluid composition 50 through the vortex chamber 42 in the relatively high resistance tangential direction. The angle of the vortex inlet passageways 66, 68 and the primary passageway 52 may be the same (as illustrated in FIG. 5) or they may be at angles that are different from each other. For example, the vortex inlet passageway 68 could be aligned with the primary passageway 52 while the vortex inlet passageway 66 could be at an acute angle to the primary passageway 52.

In another configuration, the primary passageway 52 is removed and all of the flow must pass through the control passageways 54, 56.

Figure 6B:
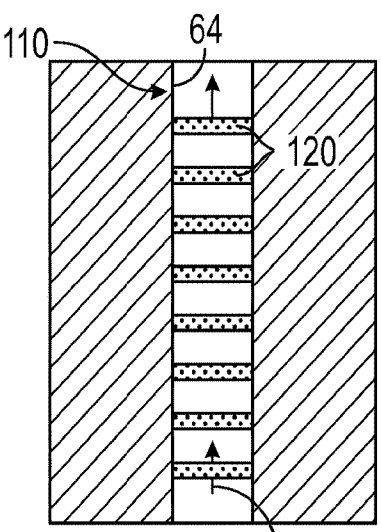
FIGS. 6A through 6D are schematic views of surface energy dependent flow resistors having a support structure extending across a control passage for use in an autonomous control valve in accordance with various embodiments of the present disclosure.
Figure 6A:
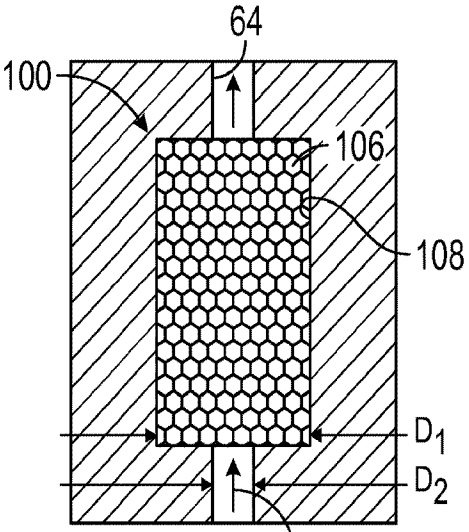

FIG. 6A is a schematic view of the surface energy dependent flow resistor 100 in the control passageway 64. The flow resistor 100 includes a support structure 106 extending substantially across an entire cross-section of the control passageway 64, and thus, fluid composition 50 passing through the control passageway 64 passes through the support structure 106. The support structure 106 is supported in a chamber 108 having a diameter $D_1$ (or other transverse dimension) that is greater than a diameter $D_2$ (or other transverse dimension) of the control passageway 64. In other embodiments, the diameters $D_1$ and $D_2$ are substantially similar.

The support structure 106 may be constructed of a naturally or intrinsically hydrophobic and/or oleophilic material, and/or may be coated with a hydrophobic and/or oleophilic coating on a plurality of the exposed outer surfaces thereof. In addition, the chamber 108 in which the support structure 106 is contained may also be coated with a hydrophobic and/or oleophilic coating. The support structure 106 may be a particle bed comprising discrete sand, gravel, nails, conglomerate, or other particulates. Also, in some embodiments, the support structure 106 may include a filter or mesh such as a weave, braid, knit, link or fabric. Hydrophobic materials that may be included in the construction of the support structure 106 include silica/polyaniline (PAni), alkanes, silica, silicone, and fluorocarbon. The material of the hydrophobic support structure 106 may, in some embodiments include nanoparticles, such as an agglomeration of alumina nanoparticles that are coated with carboxylic acid or a coating of copper nanoparticles.

In other example embodiments, the support structure 106 may be constructed of a hydrophobic ceramic material such as a ceramic comprising a lanthanide oxide. Although ceramic materials are generally hydrophilic, a class of ceramics comprising the entire lanthanide oxide series, ranging from ceria to lutecia, is intrinsically hydrophobic. These hydrophobic ceramic materials provide durability to the support structure 106 that enable the support structure 106 to withstand the harsh downhole environments without deterioration or loosing hydrophobicity.

Another material that may be employed in the construction of the support structure 106, e.g., to be used in a coating of support structure 106, is a hydrophobically modified water soluble poly-(dimethylaminoethylmethacrylate) chemical additive. One such material is manufactured by Halliburton Energy Services, Inc., and is known under the trade name HPT™-1 Many polymers are also hydrophobic and/or hydrophobically modified, and may be employed in the construction and/or coating of the support structure 106. For example, material such as acrylics, carbonates, amides and imides, olefins, etc, may be hydrophobic, and each may be included in the construction and/or coating of the support structure 106. Some of the materials, such as PTFE, exhibit both hydrophobic and oleophobic properties but have a different degree of hydrophobicity and oleophobicity.

It should be appreciated that the flow resistor 102 of FIG. 3A may appear identical to the flow resistor 100 of FIG. 6A, differing only in the materials of construction. The flow resistor 102 may include a support structure (not shown) extending across a cross section a control passageway that may include any or all of the characteristics of the support structure 106, except that the support structure of the flow resistor 102 may include hydrophilic materials and/or coatings as opposed to the hydrophobic material described for the support structure 106. Hydrophilic materials include silane coupling agents (silane can also be hydrophobic). Silicone can be modified to contain hydrophilic groups, such as with an increase in the alkylene oxide content. Siloxanes are hydrophilic. Many polymers and polymer oxide surfaces are hydrophilic, such as polyethyenimine, polyacrylamide, polyethers, etc.

Figure 6D:
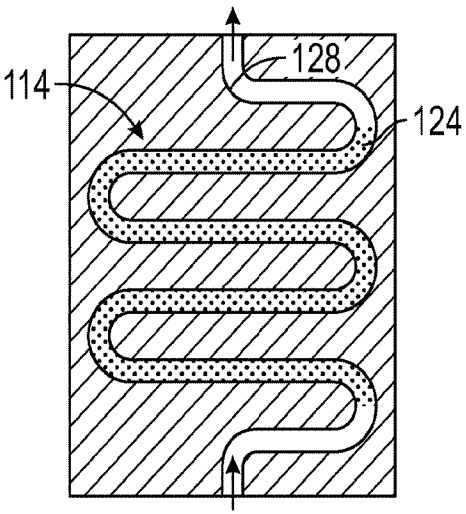
Figure 6C:
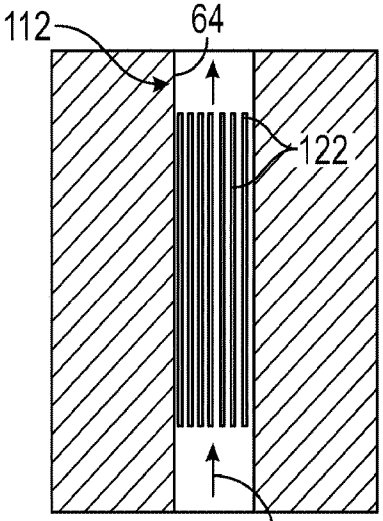

FIGS. 6B through 6C are schematic views of example alternate surface energy dependent flow resistors 110, 112, 114, which may be provided within control passageways such as control passageways 54, 56 (FIG. 3A). The flow resistors 110, 112, 114 may be provided in addition to, or in place of the flow resistors 100, 102 (FIG. 3A). The energy dependent flow resistor 110, 112, 114 may be constructed with any of the hydrophobic or hydrophilic materials discussed above, any oloephobic or oleophilic materials, or any other surface energy sensitive materials in accordance with elements of the present disclosure.

The flow resistor 110 illustrated in FIG. 6B includes a support structure 120 comprising a plurality of membranes extending into the flow passage 64. As illustrated, the membranes are arranged to extend across the entire flow passage 64 such that the fluid composition 50 must pass through each membrane to pass through the control passageway 64. In other embodiments, the membranes (or any of the other support structures described herein) may extend substantially into the flow passageway 60 but less than across the entire flow passage. Thus, the flow of fluid composition 50 may be sufficiently influenced by the hydrophobic, hydrophilic, oloephobic or oleophilic materials of the membranes to guide the flow of fluid composition through high or low resistance pathways through a valve as discussed above.

The flow resistor 112 illustrated in FIG. 6C includes a support structure 122 comprising a bundle of tubes extending along the length of the control passageway 64. Each of the individual tubes may be constructed of an intrinsically hydrophobic, hydrophilic, oloephobic or oleophilic material and/or coated on inside and outside surfaces with a hydrophobic, hydrophilic, oloephobic or oleophilic material. The fluid composition 50, whether flowing through a tube or around a tube, will effectively influenced by surface energy sensitive material of the support structure 122.

The flow resistor 114 illustrated in FIG. 6D includes a support structure 124 extending across a control passageway 128. The support structure 124 may comprise sand coated with a hydrophobic, hydrophilic, oloephobic or oleophilic material, or any of the support structures described above. The control passageway 128 may comprise a tortuous pathway or other arrangement to encourage flow of the fluid composition 50 through the support structure 124.

Figure 7B:
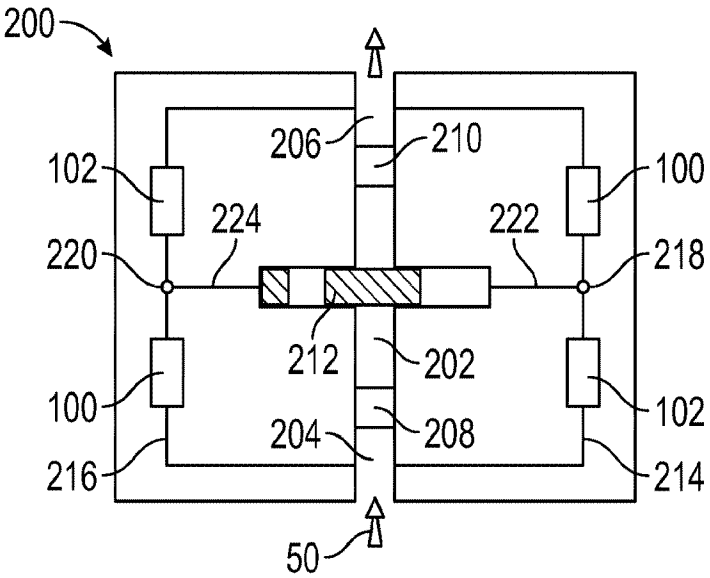
FIGS. 7A and 7B are schematic views of another alternate autonomous control valve including a closure member therein, the closure member controlled by surface energy dependent flow resistors and illustrated in respective open and closed positions.
Figure 7A:
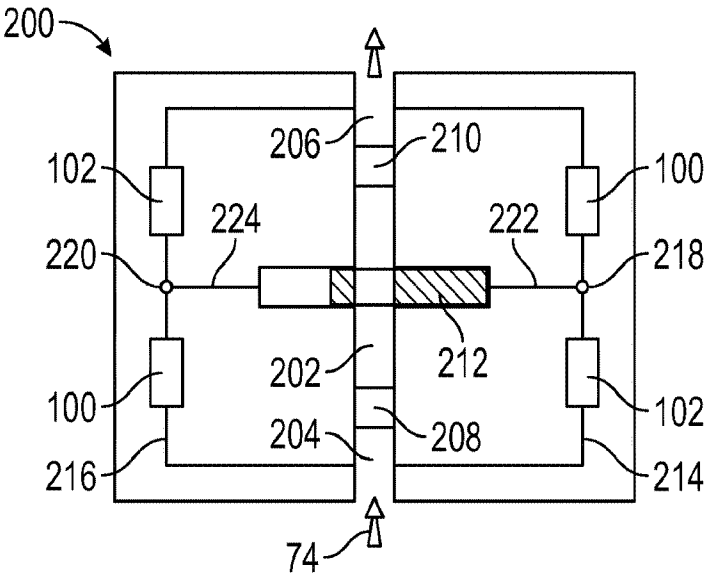

FIGS. 7A and 7B are schematic views of an alternate control valve 200 in open and closed operational positions that may employ one or more of the flow resistors 100, 102, 110, 112, 114 discussed above. The control valve 200 includes a primary passageway 202 having an inlet 204 and an outlet 206. The primary passageway 202 provides the primary flow path for fluid a fluid composition 74 (FIG. 7A) and 50 (FIG. 7B) through the control valve 200. The control valve 200 is responsive to flow of the fluid composition 74 containing a relatively high proportion of a desired fluid component to move to the open operational position illustrated in FIG. 7A and responsive to flow of the fluid composition 50 containing a relatively low proportion of a desired fluid component to move to the closed operational position illustrated in FIG. 7B.

In the embodiment illustrated in FIGS. 7A and 7B, a pair of fluid flow resistors 208, 210 are positioned within primary fluid passageway 202. Fluid flow resistors 208, 210 may be of any suitable type, and are used to create a desired pressure drop in the fluid composition 74, 50 passing through primary fluid passageway 202, which assures proper operation of the control valve 200. In one or more embodiments, one or both of the fluid flow resistors 208, 210 may be hydrophobic, hydrophilic, oleophobic, and/or oleophilic.

A closure member 212 is positioned relative to primary fluid passageway 202 such that the closure member 212 has a first "open" operational position (FIG. 7A) wherein fluid flow through primary fluid passageway 202 is allowed, and a second "closed" position (FIG. 7B) wherein fluid flow through primary fluid passageway 202 is prevented. In the illustrated embodiment, the closure member 212 operates as a pressure operated shuttle valve. Even though the closure member 212 is illustrated as operating as a shuttle valve, those skilled in the art will understand that other types of pressure operated closure members could alternatively be used in a control valve including sliding sleeves, ball valves, flapper valves or the like. Also, even though the closure member 212 is depicted as having two positions; namely "open" and "closed" positions, those skilled in the art will understand that closure members operating in a control valve could alternatively have two open positions with different levels of fluid choking or more than two positions such as an open position, one or more choking positions and a closed position.

The control valve 200 includes a bridge network having two control fluid passageways 214, 216 branching from the primary fluid passageway 202 upstream of the closure member 212 and rejoining the primary fluid passageway downstream of the closure member 212. As illustrated, control passageways 214, 216 are in fluid communication with primary fluid passageway 202, however, those skilled in the art will recognize that control passageways 214, 216 could alternatively branch from a fluid pathway other than primary fluid passageway. In any such configurations, control passageways 214, 216 will be considered to have common fluid inlets and common fluid outlets with the main fluid pathway so long as control passageways 214, 216 and primary fluid passageway 202 directly or indirectly share the same pressure sources, such as wellbore pressure and tubing pressure, or are otherwise fluidically connected. It should be noted that the fluid flowrate through primary fluid passageway 202 may be much greater than the flowrate through control passageways 214, 216. For example, the ratio in the fluid flowrate between primary fluid passageway 202 and control passageways 214, 216 may be between about 5 to 1 and about 20 to 1 and is preferably greater than 10 to 1.

Control passageway 214 has two fluid flow resistors 100, 102 positioned in series with a pressure output terminal 218 positioned therebetween. Likewise, control passageway 216 has two fluid flow resistors 102, 100 positioned in series in reverse order with a pressure output terminal 220 positioned therebetween. Pressure from pressure output terminal 218 is routed to closure member 212 via fluid pathway 222 and pressure from pressure output terminal 220 is routed to closure member 212 via fluid pathway 224. As such, if the pressure at pressure output terminal 220 is higher than the pressure at pressure output terminal 218, closure member 212 is biased to the open position (FIG. 7A). Alternatively, if the pressure at pressure output terminal 218 is higher than the pressure at pressure output terminal 220, closure member 212 162 is biased to the closed position (FIG. 7B).

The pressure difference between pressure output terminals 220, 218 is created due to differences in flow resistance and associated pressure drops in the various fluid flow resistors 100, 102. As shown, the bridge network can be described as two parallel control passageways each having two fluid flow resistors in series with a pressure output terminal therebetween. This configuration simulates the common Wheatstone bridge circuit. With this configuration, fluid flow resistors 100, 102 can be arranged such that the flow of a fluid composition 74 (FIG. 7A) having a relatively high proportion of a desired fluid (such as oil) through the control valve 200 generates a differential pressure between pressure output terminals 220, 218 that biases the closure member 212 to the open position and the flow of an undesired fluid composition 50 (FIG. 7B) having a relatively high proportion of an undesired fluid (such as water) through control valve 200 generates a differential pressure between pressure output terminals 220, 218 that biases the closure member 212 to the closed position.

For example, fluid flow resistors 100, 102 can be selected such that their flow resistance will change or be dependent upon their wettability by the fluid composition 74, 50 flowing therethrough as described above. In the example discussed above wherein oil is the desired fluid and water is the undesired fluid, fluid flow resistors 102 may be constructed with a hydrophilic and/or oleophobic material and fluid flow resistors 100 may be constructed of a hydrophobic and or oleophilic material. In this configuration, when the desired fluid composition 74 flows through control passageway 214, it experience a greater pressure drop in fluid flow resistor 102 (hydrophilic and/or oleophobic), than in fluid flow resistor 100 (hydrophobic and/or oleophilic). Likewise, as the desired fluid composition 74 flows through control passageway 216, it experiences a lower pressure drop in fluid flow resistor 100 than in fluid flow resistor 102. As the total pressure drop across each control passageway 214, 216 must be the same due to the common fluid inlets and common fluid outlets, the pressure at pressure output terminals 220, 218 is different. When the fluid composition 74 (FIG. 7A) flows through the control valve 200, the pressure at pressure output terminal 218 is less than the pressure at pressure output terminal 220, thus biasing the closure member 212 to the open position.

Also, in this configuration, when the fluid composition 50 (FIG. 7B) having a relatively high proportion of an undesired fluid flows through control passageway 214, it experiences a lower pressure drop in fluid flow resistor 102 (hydrophilic and/or oleophobic) than in fluid flow resistor 100 (hydrophobic and/or oleophilic). Likewise, as the undesired fluid flows through the control passageway 216, it experiences a greater pressure drop in fluid flow resistor 100 (hydrophobic and/or oleophilic), than in fluid flow resistor 102 (hydrophilic and/or oleophobic). As the total pressure drop across each control passageway 214, 216 must be the same, due to the common fluid inlets and common fluid outlets, the pressure at pressure output terminals 220, 218 is different. In this case, the pressure at pressure output terminal 218 is greater than the pressure at pressure output terminal 220, thus biasing closure member 212 to the closed position shown in FIG. 7B.

It is to be clearly understood that other types and combinations of fluid flow resistors may be used to achieve fluid flow control through control valve 200. For example, if oil and water are not the desired and undesired fluids, fluid flow resistors sensitive to the particular fluids may be constructed. Even though FIGS. 7A and 7B have been described as having the same types of fluid flow resistors in each control passageway but in reverse order, it should be understood by those skilled in the art that other configurations of fluid flow resistors that create the desired pressure difference between the pressure output terminals are possible and are considered within the scope of the present disclosure. Also, even though FIGS. 7A and 7B have been described as having two fluid flow resistors in each control passageway, it should be understood by those skilled in the art that other configurations having more or less than two fluid flow resistors that create the desired pressure difference between the pressure output terminals are possible and are considered within the scope of the present invention.

Figure 8B:
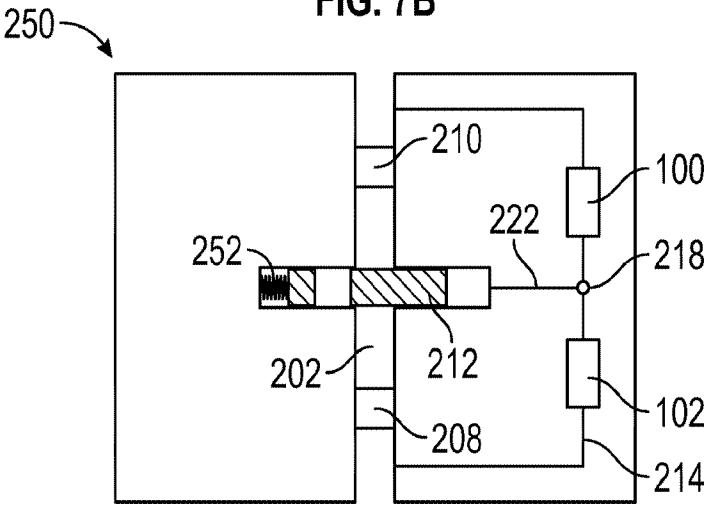
FIGS. 8A and 8B are schematic views of another alternate autonomous control valve including a biasing member and surface energy dependent flow resistors operably coupled to the closure member.
Figure 8A:
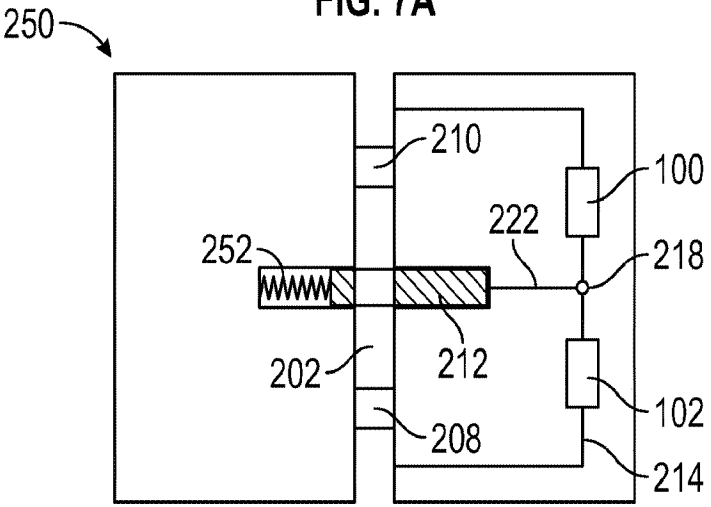

Referring next to FIGS. 8A and 8B, therein is depicted a schematic illustration of a control valve 250 of the present disclosure in its open and closed operating positions. Control valve 250 includes the primary fluid passageway 202, closure member 212 and control passageway 214 as described above. The control valve 250, however, does not include the control passageway 216 (FIG. 7A). Rather, the control valve 250 includes a biasing member 252, e.g., a spring, which may operate to impart a biasing force to closure member that opposes the pressure at the pressure output terminal 218. Thus, when the force generated by biasing member 252 is greater than the force generated by the pressure transmitted from the pressure output terminal 218, the closure member 212 moves to the open position (FIG. 8A). When the force generated by biasing member 252 is less than the force generated by the pressure transmitted from the pressure output terminal 218, the closure member 212 moves to the closed position (FIG. 8B). In this manner, the control valve 250 may operate with only a single control passageway 214.

Figure 9:
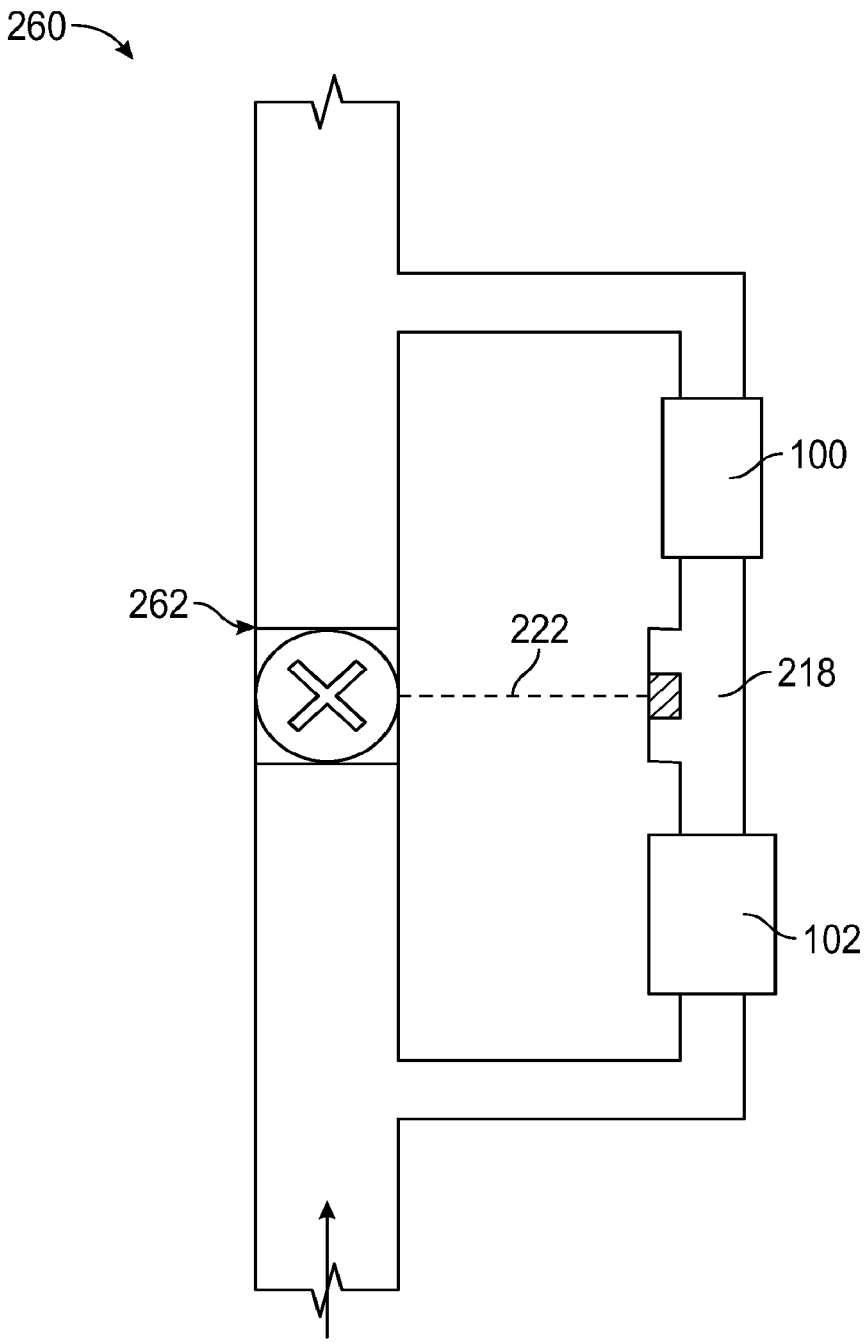
FIG. 9 is a schematic view of another alternate autonomous control valve including a general flow restrictor.

Referring next to FIG. 9, a control valve 260 is illustrated having a flow control device 262 disposed in the primary fluid passageway 202. The flow control device 262 can be any sort of valve or variable resistance flow restrictor where the differential pressure created by the flow resistors 100, 102 (wherein the flow resistors have different surface energy), and are used to create a pressure signal transmittable through fluid pathway 222 to shift a flow restriction. The flow control device 262 may be directly responsive to the pressure signal, and/or indirectly responsive the pressure signal. For example, the pressure signal may the interpreted electronics (not shown) that are responsive to the pressure signal to provide instructions to the flow control device 262 to vary the flow resistance therethrough.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a downhole fluid control valve. The downhole fluid control valve includes an inlet, an outlet and a primary flow passageway extending from the inlet and in fluid communication with the outlet. At least one control passageway branches from the primary flow passageway, and at least one surface energy dependent flow resistor has a support structure extending across the at least one control passageway such that the flow of a fluid composition between the inlet and the outlet is permitted or restricted based on the wettability of the support structure by the fluid composition.

In one or more embodiments, the support structure of the at least one surface energy dependent flow resistor is constructed of at least one surface energy sensitive material selected from the group consisting of a hydrophobic material, a hydrophilic material, an oleophilic material and a oleophobic material. The at least one surface energy sensitive material may include a hydrophobic ceramic material comprising a lanthanide oxide.

In some embodiments, the support structure may be coated with the at least one surface energy sensitive material, and in some embodiments, the support structure includes discrete sand, gravel or conglomerate particulates coated with the at least one surface energy sensitive material.

In one or more example embodiments, the at least one control passageway includes a pair of discrete control passageways branching from the primary flow passageway, and a first control passageway of the pair of control passageways includes a hydrophobic or oleophilic support structure extending thereacross. A second control passageway of the pair of control passageways may include a hydrophilic or oleophobic support structure extending thereacross. In some embodiments, the first and second passageways each include a control port directed at the primary flow passageway such that flow from the control ports directs flow from the primary flow passageway along relatively high resistance and relatively low resistance pathways through the control valve. In example embodiments, the downhole fluid control valve further includes a vortex chamber and the relatively low resistance pathway includes a first vortex inlet passageway extending into the vortex chamber along a substantially radial direction with respect to the vortex chamber and the relatively high resistance pathway includes a second vortex inlet passageway extending into the vortex chamber along a substantially tangential direction with respect to the vortex chamber. In some embodiments, the downhole fluid control valve further includes a closure member disposed to move between open and closed positions to respectively permit and restrict flow through the primary flow passageway. The closure member may be operably coupled to a pressure output terminal in each of control passageways to move between the open and closed positions based on a pressure difference between the pressure output terminals.

In some example embodiments, the control valve is responsive to changes in fluid compositions having a difference in viscosity of less than 1 centipose to permit and restrict flow of the fluid composition between the inlet and the outlet. In embodiments, the support structure includes a weave, braid, knit, link or fabric extending across the at least one control passageway. The support structure may include a bundle of tubes extending across the at least one control passageway. In some example embodiments, the support structure is supported in a chamber having a transverse dimension larger than a transverse dimension of the at least one control passageway.

According to another aspect, the disclosure is directed to a downhole flow control system. The system includes an inlet fluidly coupled to a subterranean reservoir defined in a geologic formation, an outlet extending to an interior passageway of a tubing string extending to a surface location, a primary flow passageway extending from the inlet and in fluid communication with the outlet, at least one control passageway branching from the primary flow passageway, and at least one surface energy dependent flow resistor having a support structure extending across the at least one control passageway such that the flow of a fluid composition between the inlet and the outlet is permitted or restricted based on the wettability of the support structure by the fluid composition.

In one or more example embodiments, the downhole fluid control system further includes a screen defined between the downhole reservoir and the inlet, the screen operable to prohibit particulates of a particular size to flow to the inlet. In some embodiments, the support structure includes discrete sand, gravel or conglomerate or particulates coated with a hydrophobic material. In some embodiments, the support structure includes an intrinsically hydrophobic ceramic material.

According to another aspect, the disclosure is directed to a method of controlling a downhole fluid flow. The method includes (a) flowing a fluid composition through an inlet into a primary flow passageway, (b) branching a portion of the fluid composition from the primary flow passageway to at least one control passageway including at least one surface energy dependent flow resistor therein, and (c) permitting or resisting flow of the fluid composition from the primary flow passageway to an outlet based on the wettability of a support structure of the at least one surface energy dependent flow resistor extending across the at least one control passageway by the fluid composition.

In some embodiments, the method further includes permitting flow of a first fluid composition based on the wettability of the support structure by the first fluid composition and restricting flow of a second fluid composition based on the wettability of the support structure by the second fluid composition, and wherein a viscosity difference between the first and second fluid compositions is less than 1 centipose. In one or more example embodiments, the the first fluid composition has a relatively high proportion of oil and wherein the second fluid composition has a relatively high proportion of water.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A downhole fluid control valve comprising:

an inlet;

an outlet;

a primary flow passageway extending from the inlet and in fluid communication with the outlet;

a pair of discrete control passageways branching from the primary flow passageway, the pair of discrete control passageways including a first control passageway and a second control passageway; and at least first and second surface energy dependent flow resistors each having a support structure constructed of at least one solid surface energy sensitive material extending substantially across an entire cross-section of a respective one of the pair of discrete control passageways such that a flow of a fluid composition between the inlet and the outlet must pass through the support structure and is permitted or restricted based on the wettability of the support structure by the fluid composition, and wherein the first surface energy dependent flow resistor has a different wettability by the fluid composition than the second surface energy dependent flow resistor.

2. The downhole fluid control valve according to claim 1, wherein the at least one surface energy sensitive material is selected from the group consisting of a. hydrophobic material, a hydrophilic material, an oleophilic material and a oleophobic material.

3. The downhole fluid control valve according to claim 2, wherein the at least one surface energy sensitive material of one of the first and second surface energy dependent flow resistors comprises a hydrophobic ceramic material comprising lanthanide oxide.

4. The downhole fluid control valve according to claim 2, wherein the at least one solid surface energy sensitive material of the support structure is coated with at least one surface energy sensitive coating.

5. The downhole fluid control valve according to claim 2, wherein the support structure extending across the first control passageway is hydrophobic and wherein the support structure extending across the second control passageway is hydrophilic.

6. The downhole fluid control valve according to claim 5, wherein the first and second control passageways each include a control port directed at the primary flow passageway such that flow from the control ports directs flow from the primary flow passageway along a first resistance pathway and a second resistance pathway through the control valve.

7. The downhole fluid control valve according to claim 6, further comprising a vortex chamber and wherein the second resistance pathway includes a first vortex inlet passageway extending into the vortex chamber along a radial direction with respect to the vortex chamber and wherein the first resistance pathway includes a second vortex inlet passageway extending into the vortex chamber along a tangential direction with respect to the vortex chamber.

8. The downhole fluid control valve according to claim 5, further comprising a closure member disposed to move between open and closed positions to respectively permit and restrict flow through the primary flow passageway, and wherein the closure member is operably coupled to a pressure output terminal in each of control passageways to move between the open and closed positions based on a pressure difference between the pressure output terminals.

9. The downhole fluid control valve according to claim 2, wherein the support structure extending across the first control passageway is oleophilic and wherein the support structure extending across the second control passageway is oleophobic.

10. The downhole fluid control valve according to claim 1, wherein at least one of the support structures comprises a weave, braid, knit, link or fabric extending across the respective control passageway.

11. The downhole fluid control valve according to claim 1, wherein the support structure of at least one of the first and second surface energy dependent flow resistors comprises a bundle of tubes extending across the respective control passageway.

12. The downhole fluid control valve according to claim 1, wherein at least one of the support structures is supported in a chamber having a transverse dimension larger than a transverse dimension of the respective control passageway.

13. The downhole fluid control valve according to claim I, wherein the solid surface energy sensitive material of one of the first and second surface energy dependent flow resistors comprises a hydrophobic polymer.

14. The downhole fluid control valve according to claim 13, wherein the hydrophobic polymer comprises a solid PTFE material.

15. A downhole flow control system comprising:

an inlet fluidly coupled to a subterranean reservoir defined in a geologic formation;

an outlet extending to an interior passageway of a tubing string extending to a surface location;

a primary flow passageway extending from the inlet and in fluid communication with the outlet;

first and second control passageways branching from the primary flow passageway;

a first surface energy dependent flow resistor having a first support structure constructed of a first solid surface energy sensitive material extending substantially across an entire cross- section of the first control passageway such that a flow of a fluid composition through the first control passageway must flow through the first support structure and is permitted or restricted based on the wettability of the first support structure by the fluid composition; and a second surface energy dependent flow resistor having a second support structure constructed of a second solid surface energy sensitive material extending substantially across an entire cross-section of the second control passageway such that a flow of the fluid composition through the second control passageway must flow through the second support structure and is permitted or restricted based on the wettability of the second support structure by the fluid composition, and wherein the second surface energy dependent flow resistor has a different wettability by the fluid composition than the first surface energy dependent flow resistor.

16. The downhole fluid control system according to claim 15, further comprising a screen defined between the downhole reservoir and the inlet, the screen operable to prohibit particulates of a particular size to flow to the inlet.

17. The downhole fluid control system according to claim 15, wherein at least one of the first and second support structures comprise a hydrophobic ceramic material comprising a lanthanide oxide.

18. The downhole flow control system according to claim 15, wherein at least one of the first and second support structures is supported in a chamber having a transverse dimension larger than a transverse dimension of the respective control passageway.

19. A method of controlling a downhole fluid flow, the method comprising:

flowing a fluid composition through an inlet into a primary flow passageway;

branching a portion of the fluid composition from the primary flow passageway to at least a first control passageway including a first surface energy dependent flow resistor therein and a second control passageway including a second surface energy dependent flow resistor therein; and permitting or resisting flow of the fluid composition from the primary flow passageway to an outlet based on different wettability characteristics with respect to the fluid composition of a support stnicture of the first surface energy dependent flow resistor con stnicted of a first solid surface energy sensitive material extending substantially across an entire cross-section of the first control passageway and a support structure of the second surface energy dependent flow resistor constructed of a second solid surface energy sensitive mated al extending substantially across an entire cross-section of the second control passageway.

20. The method according to claim 19, further comprising permitting flow of a first fluid composition based on the wettability of the first and second support structures by the first fluid composition and restricting flow of a second fluid composition based on the wettability of the first and second support structures by the second fluid composition, and wherein a viscosity difference between the first and second fluid compositions is less than 1 centipoise.

* * * * *